US008753479B2

(12) United States Patent
Esser et al.

(10) Patent No.: US 8,753,479 B2
(45) Date of Patent: Jun. 17, 2014

(54) PRODUCTION OF PAPER, CARD AND BOARD

(75) Inventors: Anton Esser, Limburgerhof (DE); Hans-Joachim Haehnle, Neustadt (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/526,710

(22) Filed: Jun. 19, 2012

(65) Prior Publication Data

US 2012/0325420 A1 Dec. 27, 2012

Related U.S. Application Data

(60) Provisional application No. 61/499,204, filed on Jun. 21, 2011.

(51) Int. Cl.

| | |
|---|---|
| ***D21H 17/37*** | (2006.01) |
| ***D21H 17/38*** | (2006.01) |
| ***D21H 17/42*** | (2006.01) |
| ***D21H 17/43*** | (2006.01) |
| ***D21H 17/44*** | (2006.01) |
| ***D21H 17/45*** | (2006.01) |
| ***D21H 17/63*** | (2006.01) |
| ***D21H 21/10*** | (2006.01) |
| ***D21H 21/18*** | (2006.01) |
| ***D21H 23/04*** | (2006.01) |

(52) U.S. Cl.

USPC ..... 162/168.3; 162/158; 162/164.1; 162/168.1; 162/181.1; 162/185; 162/205; 526/72; 526/277; 526/387; 526/303.1; 526/317.1; 526/318.2; 526/318.3

(58) Field of Classification Search

USPC ..... 162/158, 164.1, 164.5, 164.6, 162/168.1–168.3, 181.1–181.8, 183, 185; 526/72, 303.1, 274, 307.4, 277, 307.6, 526/278, 317.1, 286, 318.2, 287, 318.3; 524/1, 543, 555, 556, 599, 606, 609, 524/610, 612

See application file for complete search history.

(56) References Cited

U.S. PATENT DOCUMENTS

| | | | | |
|---|---|---|---|---|
| 6,024,836 | A | 2/2000 | Sollinger et al. | |
| 6,103,065 | A * | 8/2000 | Humphreys et al. | 162/181.8 |
| 6,197,919 | B1 * | 3/2001 | Crisp et al. | 528/230 |
| 6,616,806 | B2 * | 9/2003 | I Chen | 162/168.1 |
| 7,396,874 | B2 * | 7/2008 | Hollomon et al. | 524/815 |
| 7,547,376 | B2 * | 6/2009 | Satoh | 162/168.3 |
| 2010/0084103 | A1 * | 4/2010 | Reinicke | 162/164.6 |
| 2011/0079365 | A1 | 4/2011 | Haehnle et al. | |

FOREIGN PATENT DOCUMENTS

| | | | | |
|---|---|---|---|---|
| DE | 1 948 994 | | 4/1971 | |
| EP | 0 780 513 | B1 | 1/2002 | |
| GB | 1314539 | | 4/1973 | |
| JP | 02-227484 | A * | 10/1991 | |
| WO | WO 98/06898 | A1 * | 2/1998 | |
| WO | WO 2009/156274 | A1 | 12/2009 | |
| WO | WO 2009156274 | A1 * | 12/2009 | D21H 21/20 |
| WO | WO 2011/048000 | A1 | 4/2011 | |

OTHER PUBLICATIONS

U.S. Appl. No. 13/502,885, filed Apr. 19, 2012, Esser.
U.S. Appl. No. 13/969,774, filed Aug. 19, 2013, Esser, et al.

* cited by examiner

*Primary Examiner* — Dennis Cordray
(74) *Attorney, Agent, or Firm* — Oblon, Spivak, McClelland, Maier & Neustadt, L.L.P.

(57) ABSTRACT

The invention relates to a process for the production of paper, card and board, including the steps of draining a filler-containing paper stock, having a certain fibrous concentration and containing at least one water-soluble amphoteric copolymer, with sheet formation in a wire section, then pressing the paper in a press section, diluting the paper stock to a fibrous concentration in the range from 5 to 15 g/l, draining the diluted paper stock to form a sheet, and then pressing the sheet in the press section to a solids content G(x) wt % or greater, such that G(x) computes according to:

$$G(x)=48+(x-15)\cdot 0.4,$$

where x is the numerical value of a filler content of the dry paper, card or board (in wt %), and G(x) is a numerical value of the minimal solids content (in wt %) to which the sheet is pressed.

16 Claims, No Drawings

PRODUCTION OF PAPER, CARD AND BOARD

CROSS-REFERENCE TO RELATED APPLICATIONS

This application is based upon and claims the benefit of priority to U.S. provisional application No. 61/499,204 filed on Jun. 21, 2011, the contents of which are incorporated herein by reference.

BACKGROUND OF THE INVENTION

The present invention relates to a process for production of paper, card and board comprising draining a filler-containing paper stock comprising at least one water-soluble amphoteric copolymer with sheet formation in the wire section and then pressing the paper in the press section.

The development of novel processes for production of paper takes place at various points in the process. Improved papers are obtained through novel feedstocks or else modified dosing processes. But faster and faster papermachines also impose novel requirements on the production process.

Initial wet web strength is one limiting factor on the way to any further increase in papermachine speed. Initial wet web strength limits the maximum force which can be exerted on a sheet which has just been formed in the papermachine, has traveled through the wire and press sections of the machine and passed into the dryer section. In the process, the sheet has to be pulled off from the press rolls. To be able to ensure papermachine operation without broken ends, the pull-off force applied at this point has to be distinctly less than the initial wet web strength of the moist paper. Increased initial wet web strength permits application of higher pull-off forces and hence faster papermachine operation, cf. EP-B-0 780 513.

Initial wet web strength is the strength of a never-dried paper. It is the strength of a wet as-produced paper after passing through the wire and press sections of the papermachine.

In the press section, the moist fibrous web is couched by a suction pickup roll onto the press felt. The office of the press felt is to transport the fibrous web through press nips in various modified forms. The solids content of the web is up to not more than 55%, depending on the design of the press section and the composition of the paper stock. The solids content increases with the pressure exerted in the press on the passing paper web. The pressure and hence the solids content of the paper web can be varied within relatively wide limits in many papermachines.

It is known that initial wet web strength can be increased by increasing the solids content of the paper at the point between the press section and the dryer section in the production process. It is also possible to improve the solids content at this point in the process via additives for increasing drainage. But there are limits to this.

WO 2009/156274 teaches the use of amphoteric copolymers obtainable by copolymerization of N-vinylcarboxamide with anionic comonomers and subsequent hydrolysis of the vinylcarboxamide as a paper stock additive for enhancing the initial wet web strength of paper. The treatment takes place at the thick stuff stage or at the thin stuff stage in the paper production process.

Amphoteric copolymers based on acrylamide are extensively known for use as retention aids. DE 1948994 describes amphoteric copolymers based on acrylamide and having a Fikentscher K value of 200 to 250 for use as drainage aids.

They hence have a typical retention aid molecular weight in the range from 500 000 to 10 000 000 daltons and are typically added to the thin stuff.

It is further known for example to use acrylamide-based amphoteric copolymers for strength enhancement. Their molecular weight is typically in the range from 50 000 to 500 000 daltons.

It is an object of the present invention to enhance the initial wet web strength of as-produced paper prior to transitioning into the dryer section in order to achieve higher machine speeds in the paper production process compared with existing processes.

We have found that this object is achieved by a process for production of paper, card and board comprising draining a filler-containing paper stock comprising at least one water-soluble amphoteric copolymer with sheet formation in the wire section and then pressing the paper in the press section, wherein a paper stock having a fibrous concentration in the range from 20 to 40 g/l has the at least one water-soluble amphoteric copolymer added to it, then the paper stock is diluted to a fibrous concentration in the range from 5 to 15 g/l, the diluted paper stock is drained to form a sheet and the sheet is pressed in the press section to a solids content G(x) wt % or greater and G(x) computes according to $$G(x)=48+(x-15)\cdot 0.4$$

where x is the numerical value of the filler content of the dry paper, card or board (in wt %) and G(x) is the numerical value of the minimal solids content (in wt %) to which the sheet is pressed, wherein the water-soluble amphoteric copolymer is obtainable by polymerizing a mixture of a) 20 to 60 mol % of acrylamide, based on the total number of moles of monomers used for polymerization, b) 20 to 60 mol %, based on the total number of moles of monomers used for polymerization, of at least one cationic monomer, c) 20 to 60 mol %, based on the total number of moles of monomers used for polymerization, of at least one anionic monomer selected from monoethylenically unsaturated $C_3$ to $C_5$ carboxylic acids, monoethylenically unsaturated $C_3$ to $C_5$ dicarboxylic acids, sulfonic acids, phosphonic acids and/or salts thereof, d) 0 to 30 mol %, based on the total number of moles of monomers used for polymerization, of one or more monoethylenically unsaturated monomers other than said monomers (a), (b) and (c), and e) 0 to 5 mol %, based on the total number of moles of monomers used for polymerization, of one or more compounds having two or more ethylenically unsaturated double bonds in the molecule, wherein the difference between the fractions of cationic and of anionic monomer in mol %, each being based on the total number of moles of monomers used for polymerization, is not more than 10 mol %.

The present invention further provides a process for production of paper, card and board comprising draining a filler-containing paper stock comprising at least one water-soluble amphoteric copolymer with sheet formation in the wire section and then pressing the paper in the press section, wherein a paper stock having a fibrous concentration in the range from 20 to 40 g/l has the at least one water-soluble amphoteric copolymer added to it, then the paper stock is diluted to a fibrous concentration in the range from 5 to 15 g/l, the diluted paper stock is drained to form a sheet and the sheet is pressed in the press section to a solids content ≥48 wt % and preferably of 49-53 wt %, wherein the water-soluble amphoteric copolymer is obtainable by polymerizing a mixture of a) 20 to 60 mol % of acrylamide, based on the total number of moles of monomers used for polymerization, b) 20 to 60 mol %, based on the total number of moles of monomers used for polymerization, of at least one cationic monomer, c) 20 to 60 mol %, based on the total number of moles of monomers used for polymerization, of at least one anionic monomer selected from monoethylenically unsaturated $C_3$ to $C_5$ carboxylic acids, monoethylenically unsaturated $C_3$ to $C_5$ dicarboxylic acids, sulfonic acids, phosphonic acids and/or salts thereof, d) 0 to 30 mol %, based on the total number of moles of monomers used for polymerization, of one or more monoethylenically unsaturated monomers other than said monomers (a), (b) and (c), and e) 0 to 5 mol %, based on the total number of moles of monomers used for polymerization, of one or more compounds having two or more ethylenically unsaturated double bonds in the molecule, wherein the difference between the fractions of cationic and of anionic monomer in mol %, each being based on the total number of moles of monomers used for polymerization, is not more than 10 mol %.

Paper stock is hereinbelow to be understood as referring to a mixture of water and fibrous material and further comprising, depending on the stage in the paper, card or board production process, the water-soluble amphoteric copolymer, filler and optionally paper auxiliaries.

The dry matter content of paper is to be understood as meaning the solids content of paper, card and fibrous material as determined using the oven-drying method of DIN EN ISO 638 DE.

The term pigment herein is used in the same meaning as the term filler, since pigments are used as fillers in the production of paper. Filler, as is customary in paper production, is to be understood as meaning inorganic pigment.

The process of the present invention is used in the production of paper, card and board comprising draining a filler-containing paper stock. The filler content (x) of the paper, card and board can be in the range from 5 to 40 wt % based on the paper, card or board.

One preferable embodiment gives preference to a process for production of paper having a filler content in the range from 20 to 30 wt %. Wood-free papers are papers of this type for example.

A further preferable embodiment gives preference to a process for production of paper having a filler content in the range from 10 to 20 wt %. Papers of this type are used as packaging paper in particular.

A further preferable embodiment gives preference to a process for production of paper having a filler content in the range from 5 to 15 wt %. Papers of this type are used as newsprint in particular.

A further preferable embodiment gives preference to a process for production of paper having a filler content in the range from 25 to 40 wt %, for example SC papers.

The aqueous paper stock which, according to the present invention, comprises at least a water-soluble amphoteric polymer, fibrous material as well as filler is drained in the wire section to form a sheet and the sheet is pressed, i.e., further drained, in the press section. Press section drainage is to a minimum solids content, but can also extend beyond that. This lower limit to the solids content up to which pressing has to take place is hereinafter also referred to as dry matter content limit or else as minimum solids content G(x), and is based on the pressed sheet, which is a mixture of paper stock and water. This limiting dry matter content up to which drainage is effected at a minimum is dependent on filler quantity. The limiting dry matter content G(x) of a paper having a filler content of 30 or 15 wt % computes according to the formula $$G(x)=48+(x-15)\cdot 0.4$$

as $G(30)=48+(30-15)\cdot 0.4=54$ or, respectively, as $G(15)=48+(15-15)\cdot 0.4=48$.

In other words, to produce paper having a filler content of 30 wt %, the present invention provides for pressing in the press section to a solids content of at least 54 wt % in order that paper having good initial wet web strength may be obtained.

By contrast, to produce paper having a filler content of 15 wt % or less, the present invention provides for pressing in the press section to a solids content of at least 48 wt % in order that paper having good initial wet web strength may be obtained.

One embodiment of the invention comprises pressing in the press section to at least a solids content in the range from 49 to 55 to produce paper, card and board having a filler content of 17 to 32.

Another embodiment of the invention comprises pressing in the press section to at least a solids content of 48 wt % to produce paper, card and board having a filler content of 15 or less.

The fibers are treated according to the present invention by adding the amphoteric copolymer to the paper stock at a fibrous concentration in the range from 20 to 40 g/l. A fibrous concentration of 20 to 40 g/l (corresponding to a fibrous concentration of 2 to 4 wt % based on the aqueous fibrous material) is typically what the thick stuff in paper production has. Thick stuff is distinguished from thin stuff, hereinafter to be understood as meaning a fibrous concentration in the range from 5 to 15 g/l. Following the treatment with amphoteric copolymer, the paper stock is diluted with water to a fibrous concentration in the range from 5 to 15 g/l.

Virgin and/or recovered fibers can be used according to the present invention. Any softwood or hardwood fiber typically used in the paper industry can be used, examples being mechanical pulp, bleached and unbleached chemical pulp and also fibrous materials from any annual plants. Mechanical pulp includes for example groundwood, thermomechanical pulp (TMP), chemothermomechanical pulp (CTMP), pressure groundwood, semichemical pulp, high-yield pulp and refiner mechanical pulp (RMP). Sulfate, sulfite and soda chemical pulps can be used for example. Preference is given to using unbleached chemical pulp, also known as unbleached kraft pulp. Suitable annual plants for production of fibrous materials include for example rice, wheat, sugar cane and kenaf. Pulps can also be produced using wastepaper, used alone or in admixture with other fibrous materials. The wastepaper can come from a de-inking process for example. However, it is not necessary to subject the wastepaper to be used to such a process. It is further also possible to proceed from fibrous mixtures formed from a primary stock and recycled coated broke.

In the case of bleached or unbleached chemical pulp, a fibrous material having a freeness of 20 to 30 SR can be used. The general rule is to use a fibrous material having freeness of about 30 SR, which is beaten during pulp production. Preference is given to using fibrous material having a freeness of ≤30 SR.

Treating the fibrous material with the water-soluble amphoteric polymer is done in aqueous suspension, preferably in the absence of other process chemicals customarily used in paper production. The treatment is effected in the paper production process by adding at least one water-soluble amphoteric copolymer to an aqueous paper stock having a fibrous concentration of 20 to 40 g/l. Particular preference is given to a version wherein an amphoteric copolymer is added to the aqueous paper stock at a time prior to adding the filler. It is very particularly preferable for the addition to take place after adding the dry strength enhancer starch for example.

The water-soluble amphoteric copolymers are preferably added in an amount of 0.05 to 5.00 wt %, based on fibrous material (solids).

Typical application rates are for example from 0.5 to 50 kg and preferably from 0.6 to 10 kg of at least one water-soluble amphoteric copolymer per metric ton of a dry fibrous material. It is particularly preferable for the amounts of amphoteric copolymer which are used to be in the range from 0.6 to 3 kg of polymer (solids), based per metric ton of dry fibrous material.

The time during which the amphoteric copolymer acts on a purely fibrous/paper stock material from addition to sheet formation is for example in the range from 0.5 seconds to 2 hours, preferably in the range from 1.0 seconds to 15 minutes and more preferably in the range from 2 to 20 seconds.

In addition to the amphoteric polymer, inorganic pigment is added to the fibrous material as a filler. Useful inorganic pigments include any typical paper industry pigments based on metal oxides, silicates and/or carbonates especially pigments from the group consisting of calcium carbonate, which can be used in the form of ground (GCC) lime, chalk, marble or precipitated calcium carbonate (PCC), talc, kaolin, bentonite, satin white, calcium sulfate, barium sulfate and titanium dioxide. Mixtures of two or more pigments can also be used.

The present invention utilizes inorganic pigments having an average particle size (Z-average) ≤10 μm, preferably in the range from 0.3 to 5 μm and especially in the range from 0.5 to 2 μm. Average particle size (Z-average) is generally determined herein for the inorganic pigments and also the particles of the pulverulent composition by the method of quasi-elastic light scattering (DIN-ISO 13320-1) using a Mastersizer 2000 from Malvern Instruments Ltd.

The inorganic pigment is preferably added after the water-soluble amphoteric copolymer has been added. In a preferable embodiment, the addition of the inorganic pigment takes place at a stage at which the fibrous material is already in the form of thin stuff, i.e., at a fibrous concentration of 5 to 15 g/l.

In a further preferable embodiment, the inorganic pigment is added to thick stuff as well as thin stuff, the ratio of the two additions (thick stuff addition/thin stuff addition) preferably being in the range from 5/1 to 1/5.

In addition to the amphoteric copolymers, customary paper auxiliaries may optionally be added to the paper stock, generally at a fibrous concentration of 5 to 15 g/l. Conventional paper auxiliaries include for example sizing agents, wet strength agents, cationic or anionic retention aids based on synthetic polymers and also dual systems, drainage aids, other dry strength enhancers, optical brighteners, defoamers, biocides and paper dyes. These conventional paper additives can be used in the customary amounts.

Useful sizing agents include alkyl ketene dimers (AKDs), alkenylsuccinic anhydrides (ASAs) and rosin size.

Useful retention aids include for example anionic microparticles (colloidal silica, bentonite), anionic polyacrylamides, cationic polyacrylamides, cationic starch, cationic polyethyleneimine or cationic polyvinylamine. In addition, any desired combinations thereof are conceivable, for example dual systems consisting of a cationic polymer with an anionic microparticle or an anionic polymer with a cationic microparticle. To achieve high filler retention, it is advisable to add such retention aids as can be added for example to thin stuff as well as to thick stuff.

Dry strength enhancers are synthetic dry strength enhancers such as polyvinylamine, polyethyleneimine, glyoxylated polyacrylamide (PAM) or natural dry strength enhancers such as starch.

In the papermachine, these dry matter contents are set during passage through the press section. In the press section, the moist fibrous web is couched by a suction pickup roll onto the press felt. The office of the press felt is to transport the fibrous web through press nips in various modified forms. The solids content of the web is up to not more than 55%, depending on the design of the press section and the composition of the paper stock. The solids content increases with the pressure exerted in the press on the passing paper web. The pressure and hence the solids content of the paper web can be varied within relatively wide limits in many papermachines.

The water-soluble amphoteric copolymers used in the process of the present invention generally comprise at least 20 mol %, preferably at least 25 mol % and more preferably at least 30 mol % and also generally at most 60 mol %, preferably at most 55 mol % and more preferably at most 50 mol % of acrylamide (monomers a) in polymerized form, based on the total number of moles of monomers.

The water-soluble amphoteric copolymers used in the process of the present invention further comprise generally at least 20 mol %, preferably at least 25 mol % and also generally at most 60 mol %, preferably at most 55 mol % and more preferably at most 50 mol % of a cationic monomer (monomers b) in polymerized form, based on the total number of moles of monomers.

The water-soluble amphoteric copolymers further comprise generally at least 20 mol %, preferably at least 25 mol % preferably and also generally at most 60 mol %, preferably at most 55 mol % and more preferably at most 50 mol % of an anionic monomer (monomer c) selected from the group consisting of monoethylenically unsaturated $C_3$ to $C_5$ monocarboxylic acids, monoethylenically unsaturated $C_3$ to $C_5$ dicarboxylic acids, sulfonic acids, phosphonic acids and/or salts thereof in polymerized form, based on the total number of moles of monomers.

In addition, the water-soluble amphoteric copolymers may comprise in polymerized form up to 30 mol %, preferably up to 20 mol %, especially up to 15 mol % and more preferably from 0 to 10 mol % of one or more monoethylenically unsaturated monomers (monomer d) other than monomers a), b) and c), based on the total number of moles of monomers.

In addition, the water-soluble amphoteric copolymers may comprise in polymerized form up to 5 mol %, preferably up to 3 mol %, especially up to 1 mol % and more preferably 0.5 mol % of one or more ethylenically unsaturated monomers (monomer e) having two or more ethylenically unsaturated double bonds in the molecule, based on the total number of moles of monomers used for polymerization.

According to the present invention, the amount of cationic and anionic monomer is chosen such that the difference between the fractions of cationic and of anionic monomer in mol %, each being based on the total number of moles of monomers used for polymerization, is not more than 10 mol %.

The amphoteric polymers resulting therefrom are predominantly neutral at pH 7 and 20° C.

In the context of the present invention, the expression alkyl comprises straight-chain and branched alkyl groups. $C_1$-$C_6$ Alkyl and more preferably $C_1$-$C_4$ alkyl are examples of suitable alkyl groups. They more particularly include methyl, ethyl, propyl, isopropyl, n-butyl, 2-butyl, sec-butyl, tert-butyl, n-pentyl, 2-pentyl, 2-methylbutyl, 3-methylbutyl, 1,2-dimethylpropyl, 1,1-dimethylpropyl, 2,2-dimethylpropyl, 1-ethylpropyl, n-hexyl, 2-hexyl, 2-methylpentyl, 3-methylpentyl, 4-methylpentyl, 1,2-dimethylbutyl, 1,3-dimethylbutyl, 2,3-dimethylbutyl, 1,1-dimethylbutyl, 2,2-dimethylbutyl, 3,3-dimethylbutyl, 1,1,2-trimethylpropyl, 1,2,2-trimethylpropyl, 1-ethylbutyl, 2-ethylbutyl, 1-ethyl-2-methylpropyl, etc.

Compounds derivable from acrylic acid and methacrylic acid hereinbelow identified in part in abbreviated form by inserting the syllable "(meth)" into the compound derived from acrylic acid.

Cationic and anionic monomers are distinguished according to the type of dissociable groups. The charge on the unsaturated monomer is concerned here.

Cationic monomers are hereinbelow to be understood as referring to monomers comprising basic groups, these monomers being in a quaternized or protonated/protonatable state.

Anionic monomers are hereinbelow to be understood as referring to monomers having acid groups, i.e., moieties with detachable or detached proton.

Preferable cationic monomers are selected from the esters of α,β-ethylenically unsaturated mono- and dicarboxylic acids with amino alcohols, preferably $C_2$-$C_{12}$ amino alcohols, amides of α,β-ethylenically unsaturated mono- and dicarboxylic acids with diamines, and also the N—$C_1$-$C_8$-monoalkylated or N—$C_1$-$C_8$-dialkylated derivatives of these esters/amides.

Useful acid components for these esters include for example acrylic acid, methacrylic acid, fumaric acid, maleic acid, itaconic acid, crotonic acid, maleic anhydride, monobutyl maleate and mixtures thereof. Preference is given to using acrylic acid, methacrylic acid and mixtures thereof. These include for example, N-methylaminomethyl(meth)acrylate, N-methylaminoethyl(meth)acrylate, N,N-dimethylaminomethyl(meth)acrylate, N,N-dimethylaminoethyl(meth)acrylate, N,N-diethylaminoethyl(meth)acrylate, N,N-dimethylaminopropyl(meth)acrylate, N,N-diethylaminopropyl(meth)acrylate and N,N-dimethylaminocyclohexyl(meth)acrylate.

Useful further monomers (b) include N-[2-(dimethylamino)ethyl]acrylamide, N-[2-(dimethylamino)ethyl]methacrylamide, N-[3-(dimethylamino)propyl]acrylamide, N-[3-(dimethylamino)propyl]methacrylamide, N-[4-(dimethylamino)butyl]acrylamide, N-[4-(dimethylamino)butyl]methacrylamide, N-[2-(diethylamino)ethyl]acrylamide, N-[2-(diethylamino)ethyl]methacrylamide and mixtures thereof.

The aforementioned monomers are each likewise useful in the form of their respective quaternary compounds. The monomers are converted into quaternary compounds by reacting the monomers with known quaternizing agents, for example methyl chloride, benzyl chloride, ethyl chloride, butyl bromide, dimethyl sulfate and diethyl sulfate or alkyl epoxides.

Useful monomers (b) further include N-vinylimidazoles and alkylvinylimidazoles, especially methylvinylimidazoles such as for example 1-vinyl-2-methylimidazole, 3-vinylimidazole N-oxide, 2-vinylpyridine N-oxide, 4-vinylpyridine N-oxide and also betainic derivatives and quaternization products thereof.

Useful ethylenically unsaturated anionic monomers (c) include for example monoethylenically unsaturated $C_3$ to $C_5$ carboxylic acids such as acrylic acid, methacrylic acid, ethacrylic acid, crotonic acid, allylacetic acid and vinylacetic acid, monoethylenically unsaturated $C_3$ to $C_5$ dicarboxylic acids such as maleic acid, itaconic acid, fumaric acid, mesaconic acid, citraconic acid and methylenemalonic acid, sulfonic acids such as vinylsulfonic acid, styrenesulfonic acid, acrylamidomethylpropanesulfonic acid, allylsulfonic acid and methallylsulfonic acid, phosphonic acids such as vinylphosphonic acid and/or the salts thereof, especially the alkali metal, alkaline earth metal and/or ammonium salts thereof. Neutralization is effected using for example alkali metal or alkaline earth metal bases, ammonia, amines and/or alkanolamines. Examples thereof are aqueous sodium hydroxide solution, aqueous potassium hydroxide solution, sodium carbonate, potassium carbonate, sodium bicarbonate, magnesium oxide, calcium hydroxide, calcium oxide, triethanolamine, ethanolamine, morpholine, diethylenetriamine or tetraethylenepentamine.

Preferably used anionic monomers include acrylic acid, methacrylic acid, maleic acid, itaconic acid and acrylamido-2-methylpropanesulfonic acid. Polymers based on acrylic acid are particularly preferable.

The copolymers may optionally include, in polymerized form, at least one further group (d) monomer other than a monomer (a), (b) or (c), being a different monoethylenically unsaturated monomer, for modification. Examples of useful monomers (d) include nitriles of α,β-ethylenically unsaturated mono- and dicarboxylic acids, for example acrylonitrile and methacrylonitrile.

Useful group (d) monomers further include:

esters of α,β-ethylenically unsaturated mono- and dicarboxylic acids with monohydric $C_1$-$C_{30}$ alkanols, $C_2$-$C_{30}$ alkanediols and esters of vinyl alcohol and allyl alcohol with $C_1$-$C_{30}$ monocarboxylic acids, N-vinylamides, methacrylamide and also N-mono- and—disubstituted acrylamides and methacrylamides, N-vinyllactams, lactones having α,β-ethylenically unsaturated double bonds, vinylaromatics, vinyl halides, vinylidene halides, $C_2$-$C_8$ monoolefins and mixtures thereof.

Examples of representatives of this group (d) are for instance methyl(meth)acrylate, methyl ethacrylate, ethyl (meth)acrylate, ethyl ethacrylate, n-butyl(meth)acrylate, isobutyl(meth)acrylate, tert-butyl(meth)acrylate, tert-butyl ethacrylate, n-octyl(meth)acrylate, 1,1,3,3-tetramethylbutyl (meth)acrylate, ethylhexyl(meth)acrylate, methacrylamide, N-methyl(meth)acrylamide, N-ethyl(meth)acrylamide, n-propyl(meth)acrylamide, N-(n-butyl)(meth)acrylamide, tert-butyl(meth)acrylamide, n-octyl(meth)acrylamide, 1,1,3,3-tetramethylbutyl(meth)acrylamide, ethylhexyl(meth)acrylamide, vinylformamide, N-vinyl-N-methylformamide, N-vinylacetamide, N-vinyl-N-methylacetamide, N-vinyl-N-ethylacetamide, N-vinylpropionamide and N-vinyl-N-methylpropionamide and N-vinylbutyramide, 2-hydroxyethyl (meth)acrylate, 2-hydroxyethyl ethacrylate, 2-hydroxypropyl(meth)acrylate, 3-hydroxypropyl(meth)acrylate, 3-hydroxybutyl(meth)acrylate, 4-hydroxybutyl (meth)acrylate, 6-hydroxyhexyl(meth)acrylate and mixtures thereof.

Useful monomers (d) further include N-vinyllactams and their derivatives, which may include one or more $C_1$-$C_6$ alkyl substituents (as defined above) for example. These include N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam and mixtures thereof.

Useful additional monomers (d) further include ethylene, propylene, isobutylene, butadiene, styrene, α-methylstyrene, vinyl acetate, vinyl propionate, vinyl chloride, vinylidene chloride, vinyl fluoride, vinylidene fluoride and mixtures thereof.

The aforementioned monomers (d) can be used individually or as any desired mixtures.

The copolymers may be further modified by using monomers (e) in the copolymerization which comprise two or more double bonds in the molecule, examples being triallylamine, tetraallylammonium chloride, methylenebisacrylamide, glycol diacrylate, glycol dimethacrylate, glycerol triacrylate, pentaerythritol triallyl ether, at least doubly acrylated and/or methacrylated polyalkylene glycols or polyols such as pentaerythritol, sorbitol or glucose. Also suitable are allyl and vinyl ethers of polyalkylene glycols or polyols such as pentaerythritol, sorbitol or glucose. When at least one monomer of group (d) is used in the copolymerization, the amounts used range up to 2 mol %, for example in the range from 0.001 to 1 mol %.

A preferable embodiment gives copolymers obtainable by polymerization of a) 20 to 50 mol % of acrylamide, based on the total number of moles of monomers used for polymerization,
b) 25 to 40 mol %, based on the total number of moles of monomers used for polymerization, of at least one cationic monomer,
c) 25 to 40 mol %, based on the total number of moles of monomers used for polymerization, of at least one anionic monomer selected from monoethylenically unsaturated $C_3$ to $C_5$ carboxylic acids, monoethylenically unsaturated $C_3$ to $C_5$ dicarboxylic acids, sulfonic acids, phosphonic acids and/or salts thereof,
d) 0 to 30 mol %, based on the total number of moles of monomers used for polymerization, of one or more monoethylenically unsaturated monomers other than said monomers (a), (b) and (c), and
e) 0 to 5 mol %, based on the total number of moles of monomers used for polymerization, of one or more compounds having two or more ethylenically unsaturated double bonds in the molecule, wherein the difference between the fractions of cationic and of anionic monomer in mol %, each being based on the total number of moles of monomers used for polymerization, is not more than 10 mol %.

The water-soluble amphoteric copolymers are prepared by customary methods known to a person skilled in the art. The water-soluble amphoteric copolymers are obtainable by solution, precipitation, suspension or emulsion polymerization. Solution polymerization in aqueous media is preferable. Useful aqueous media include water and mixtures of water and at least one water-miscible solvent, for example an alcohol, such as methanol, ethanol, n-propanol, isopropanol, etc.

Polymerization temperatures are preferably in a range from about 30 to 200° C., more preferably from 40 to 110° C. The polymerization may take place under atmospheric pressure or else under reduced or superatmospheric pressure. A suitable pressure range is between 0.1 and 5 bar.

The anionic monomers (c) are preferably used in salt form. The pH for the copolymerization is preferably adjusted to a value in the range from 3 to 8. The pH can be kept constant during the polymerization by using a customary buffer or by measuring the pH and adding an appropriate amount of an acid or of a base.

To prepare the copolymers, the monomers can be polymerized using initiators capable of forming free radicals.

Useful initiators for free-radical polymerization include the customary peroxo and/or azo compounds for this purpose, for example alkali metal or ammonium peroxydisulfates, diacetyl peroxide, dibenzoyl peroxide, succinyl peroxide, di-tert-butyl peroxide, tert-butyl perbenzoate, tert-butyl perpivalate, tert-butyl peroxy-2-ethylhexanoate, tert-butyl permaleate, cumene hydroperoxide, diisopropyl peroxydicarbamate, bis(o-toluoyl)peroxide, didecanoyl peroxide, dioctanoyl peroxide, dilauroyl peroxide, tert-butyl perisobutyrate, tert-butyl peracetate, di-tert-amyl peroxide, tert-butyl hydroperoxide, azobisisobutyronitrile, azobis(2-amidonopropane)dihydrochloride or 2-2'-azobis(2-methylbutyronitrile). Also suitable are initiator mixtures or redox initiator systems, for example ascorbic acid/iron(II) sulfate/sodium peroxodisulfate, tert-butyl hydroperoxide/sodium disulfite, tert-butyl hydroperoxide/sodium hydroxymethanesulfinate, $H_2O_2$/CuI and also sodium or ammonium peroxodisulfate/sodium disulfite.

The polymerization can be carried out in the presence of at least one chain transfer agent to control the molecular weight. Useful chain transfer agents include the customary compounds known to a person skilled in the art, e.g., sulfur compounds, e.g., mercaptoethanol, 2-ethylhexyl thioglycolate, thioglycolic acid, sodium hypophosphite, formic acid or dodecyl mercaptan and also tribromochloromethane or other compounds that have a controlling effect on the molecular weight of the polymers obtained.

The molar mass of the water-soluble amphoteric copolymers is for example at least 10 000 and preferably at least 100 000 daltons and more particularly at least 250 000 daltons. The molar masses of the copolymers are then for example in the range from 10 000 to 10 million and preferably in the range from 100 000 to 5 million (determined by light scattering for example). This molar mass range corresponds for example to K values of 5 to 300 and preferably from 10 to 200 (determined by the method of H. Fikentscher in 5% aqueous sodium chloride solution at 25° C. and a polymer concentration of 0.1 wt %).

The water-soluble amphoteric copolymers may carry a net anionic or cationic charge or else be electrically neutral when the numbers of anionic and cationic groups in the copolymer are the same.

The process of the present invention provides for paper machine operation with fewer broken ends. Paper formed in the process exhibit distinctly enhanced initial wet web strength.

The examples which follow illustrate the invention. Percentages reported in the examples are by weight, unless otherwise stated.

EXAMPLES

Preparing the Copolymers

Example P1

Preparation of Polymer I

A 2 l 5-neck flask equipped with an anchor stirrer, a thermometer, a descending condenser and a nitrogen inlet tube was initially charged with 400 g of deionized water. In addition, the following feeds were provided:

Feed 1: The following components were mixed in a glass beaker:
250 g of deionized water
95.6 g of 50 wt % aqueous acrylamide solution 121.9 g of 80 wt % aqueous solution of acryloyloxyethyltrimethylammonium chloride
148.1 g of 32 wt % aqueous sodium acrylate solution
0.2 g of 1 wt % aqueous solution of diethylenetriaminepentaacetic acid.
About 32 g of 37% hydrochloric acid were added to set pH 4.1.

Feed 2: 60.0 g of 1 wt % aqueous solution of 2,2'-azobis(2-amidinopropane)dihydrochloride Feed 3: 16.5 g of 1 wt % aqueous solution of 2,2'-azobis(2-amidinopropane)dihydrochloride The initial charge was heated to 63° C. and a water jet pump was used to reduce the pressure until the water just started to boil. Feeds 1 and 2 were started at the same time, feed 1 being added in 2 hours and feed 2 in 3 hours to the initial charge at constant internal temperature. Upon completion of feed 2 the reaction was maintained at 63° C. for a further hour and then heated to 72° C. while the vacuum was reduced accordingly. The reaction mixture was maintained at 72° C. for a further 2 hours, at which point feed 3 was added all at once to initiate a 2 hour period of secondary polymerization at 72° C. The vacuum was then lifted and the batch was diluted with 500 g of deionized water and cooled down to room temperature. 208 g of water were distilled off during the entire polymerization.

A clear, colorless, viscous solution was obtained of a polymer composed of 40 mol % acrylamide, 30 mol % acryloyloxyethyltrimethylammonium chloride and 30 mol % sodium acrylate.

Solids content: 14.5 wt %

Viscosity: 10 600 mPas (Brookfield, spindle 7, 50 rpm, room temperature)

K value 120 (0.1% solution of polymer in 5 wt % aqueous sodium chloride solution)

Example P2

Preparation of Polymer II

A 2 I 5-neck flask equipped with an anchor stirrer, a thermometer, a descending condenser and a nitrogen inlet tube was initially charged with 400 g of deionized water. In addition, the following feeds were provided:

Feed 1: The following components were mixed in a glass beaker:
250 g of deionized water
119.5 g of 50 wt % aqueous acrylamide solution
113.8 g of 80 wt % aqueous solution of acryloyloxyethyltrimethylammonium chloride
108.6 g of 32 wt % aqueous sodium acrylate solution
0.2 g of 1 wt % aqueous solution of diethylenetriaminepentaacetic acid
About 38 g of 37% hydrochloric acid were added to set pH 4.1

Feed 2: 63.5 g of 1% aqueous solution of 2,2'-azobis(2-amidinopropane)dihydrochloride Feed 3: 17.0 g of 1% aqueous solution of 2,2'-azobis(2-amidinopropane)dihydrochloride.

The initial charge was heated to 66° C. and a water jet pump was used to reduce the pressure until the water just started to boil. Feeds 1 and 2 were started at the same time, feed 1 being added in 2 hours and feed 2 in 3 hours to the initial charge at constant internal temperature. Upon completion of feed 2 the reaction was maintained at 66° C. for a further hour and then heated to 78° C. while the vacuum was reduced accordingly. The reaction mixture was maintained at 78° C. for a further 2 hours, at which point feed 3 was added all at once to initiate a 2 hour period of secondary polymerization at 78° C. The vacuum was then lifted and the batch was diluted with 500 g of deionized water and cooled down to room temperature. 200 g of water were distilled off during the entire polymerization.

A clear, colorless, viscous solution was obtained of a polymer composed of 50 mol % acrylamide, 28 mol % acryloyloxyethyltrimethylammonium chloride and 22 mol % sodium acrylate.

Solids content: 14.1 wt %

Viscosity: 42 000 mPas (Brookfield, spindle 7, 50 rpm, room temperature)

K value 125 (0.1% solution of polymer in 5 wt % aqueous sodium chloride solution)

Example P3

Preparation of Polymer III

A 2 I 5-neck flask equipped with an anchor stirrer, a thermometer, a descending condenser and a nitrogen inlet tube was initially charged with 400 g of deionized water. In addition, the following feeds were provided:

Feed 1: The following components were mixed in a glass beaker:
250 g of deionized water
71.7 g of 50 wt % aqueous acrylamide solution
130.1 g of 80 wt % aqueous solution of acryloyloxyethyltrimethylammonium chloride
187.8 g of 32 wt % aqueous sodium acrylate solution
0.2 g of 1 wt % aqueous solution of diethylenetriaminepentaacetic acid
About 34 g of 37% hydrochloric acid were added to set pH 4.1

Feed 2: 60.3 g of 1 wt % aqueous solution of 2,2'-azobis(2-amidinopropane)dihydrochloride Feed 3: 16.0 g of 1 wt % aqueous solution of 2,2'-azobis(2-amidinopropane) dihydrochloride.

The initial charge was heated to 63° C. and a water jet pump was used to reduce the pressure until the water just started to boil. Feeds 1 and 2 were started at the same time, feed 1 being added in 2 hours and feed 2 in 3 hours to the initial charge at constant internal temperature. Upon completion of feed 2 the reaction was maintained at 63° C. for a further hour and then heated to 72° C. while the vacuum was reduced accordingly. The reaction mixture was maintained at 72° C. for a further 2 hours, at which point feed 3 was added all at once to initiate a 2 hour period of secondary polymerization at 72° C. The vacuum was then lifted and the batch was diluted with 500 g of deionized water and cooled down to room temperature. 200 g of water were distilled off during the entire polymerization.

A clear, colorless, viscous solution was obtained of a polymer composed of 30 mol % acrylamide, 32 mol % acryloyloxyethyltrimethylammonium chloride and 38 mol % sodium acrylate.

Solids content: 14.8 wt %

Viscosity: 12 000 mPas (Brookfield, spindle 7, 50 rpm, room temperature)

K value 117 (0.1% solution of polymer in 5 wt % aqueous sodium chloride solution)

Example P4

Preparation of Polymer IV (Not According to the Invention)

A 2 I 5-neck flask equipped with an anchor stirrer, a thermometer, a descending condenser and a nitrogen inlet tube was initially charged with 400 g of deionized water. In addition, the following feeds were provided:

Feed 1: The following components were mixed in a glass beaker:

287.7 g of deionized water 214.3 g of 50 wt % aqueous acrylamide solution 78.1 g of 80 wt % aqueous solution of acryloyloxyethyltrimethylammonium chloride 94.9 g of 32 wt % aqueous sodium acrylate solution 0.3 g of 1% aqueous solution of diethylenetriaminepentaacetic acid About 20 g of 37% hydrochloric acid were added to set pH 4.1.

Feed 2: 67.1 g of 1 wt % aqueous solution of 2,2'-azobis(2-amidinopropane)dihydrochloride Feed 3: 17.7 g of 1 wt % aqueous solution of 2,2'-azobis(2-amidinopropane)dihydrochloride.

The initial charge was heated to 64° C. and a water jet pump was used to reduce the pressure until the water just started to boil. Feeds 1 and 2 were started at the same time, feed 1 being added in 2 hours and feed 2 in 3 hours to the initial charge at constant internal temperature. Upon completion of feed 1 the feed vessel was flushed with 50 ml of deionized water. Upon completion of feed 2 the reaction was maintained at 64° C. for a further 30 min and then heated to 64° C., then 100 ml of deionized water were added and the mixture was heated to 72° C. while the vacuum was reduced accordingly. The reaction mixture was maintained at 72° C. for a further 1.5 hours, at which point feed 3 was added all at once to initiate a 2 hour period of secondary polymerization at 72° C. The vacuum was then lifted and the batch was diluted with 500 g of deionized water and cooled down to room temperature. 220 g of water were distilled off during the entire polymerization.

A clear, colorless, viscous solution was obtained of a polymer composed of 70 mol % acrylamide, 15 mol % acryloyloxyethyltrimethylammonium chloride and 15 mol % sodium acrylate.

Solids content: 13.6 wt %

Viscosity: 21 600 mPas (Brookfield, spindle 7, 50 rpm, room temperature)

K value 129 (0.1% solution of polymer in 5 wt % aqueous sodium chloride solution)

Example P5

Preparation of Polymer V (Not According to the Invention)

A 2 l 5-neck flask equipped with an anchor stirrer, a thermometer, a descending condenser and a nitrogen inlet tube was initially charged with 400 g of deionized water. In addition, the following feeds were provided:

Feed 1: The following components were mixed in a glass beaker:

290.2 g of deionized water 183.7 g of 50 wt % aqueous acrylamide solution 78.1 g of 80 wt % aqueous solution of acryloyloxyethyltrimethylammonium chloride 158.1 g of 32 wt % aqueous sodium acrylate solution 0.2 g of 1% aqueous solution of diethylenetriaminepentaacetic acid About 20 g of 37% hydrochloric acid were added to set pH 4.1.

Feed 2: 75.1 g of 1 wt % aqueous solution of 2,2'-azobis(2-amidinopropane)dihydrochloride Feed 3: 18.0 g of 1 wt % aqueous solution of 2,2'-azobis(2-amidinopropane)dihydrochloride.

The initial charge was heated to 66° C. and a water jet pump was used to reduce the pressure until the water just started to boil. Feeds 1 and 2 were started at the same time, feed 1 being added in 2 hours and feed 2 in 3 hours to the initial charge at constant internal temperature. Upon completion of feed 1 the feed vessel was flushed with 50 ml of deionized water. Upon completion of feed 2 the reaction was maintained at 66° C. for a further 30 min and then 100 ml of deionized water were added and the mixture was heated to 75° C. while the vacuum was reduced accordingly. The reaction mixture was maintained at 75° C. for a further 1.5 hours, at which point feed 3 was added all at once to initiate a 2 hour period of secondary polymerization at 75° C. The vacuum was then lifted and the batch was diluted with 500 g of deionized water and cooled down to room temperature. 220 g of water were distilled off during the entire polymerization.

A clear, colorless, viscous solution was obtained of a polymer composed of 60 mol % acrylamide, 15 mol % acryloyloxyethyltrimethylammonium chloride and 25 mol % sodium acrylate.

Solids content: 12.1 wt %

Viscosity: 33 500 mPas (Brookfield, spindle 7, 50 rpm, room temperature)

K value 125 (0.1% solution of polymer in 5 wt % aqueous sodium chloride solution)

Testing of above-described polymers I to V re enhancing the initial wet web strength of paper To be able to simulate the sheet-forming process on a lab scale, the thin stuff in the examples has to be adjusted to a fibrous concentration of 3.5 g/l.

Pretreatment of Fibrous Suspension

Bleached birchwood sulfate pulp was beaten in a laboratory pulper at a fibrous concentration of 4% until it was free of fiber bundles and had reached a freeness of 30° SR. The beaten stuff was subsequently admixed with an optical brightener (Blankophor® PSG) and also with a fully destructurized cationic starch (HiCat® 5163 A) and left exposed to the action thereof for 5 minutes. The cationic starch had been destructurized beforehand as a 10% starch slurry in a jet cooker at 130° C. for 1 minute. The amount of optical brightener added was 0.5 wt % of commercial product, based on the dry matter content of the fibrous suspension. The amount of cationic starch added was 0.8% of starch (solids), based on the dry matter content of the fibrous suspension. The fiber content of the fibrous suspension after starch and optical brightener had been added was 3.5% (35 g/l).

Examples 1 to 3

Three glass beakers were each filled with 50 g of the above-described pretreated fibrous suspension. Each of the glass beakers had added to it 2 g in each case of a 1 wt % aqueous solution of one of the above-described polymers I-III under gentle stirring of the fibrous suspension (corresponds to 1% of polymer (solids) per fibrous material (solids)). The fibrous suspensions were each subsequently reduced to a fibrous concentration of 0.35% by addition of water. This was followed by addition of a 20 wt % carbonate pigment slurry (PCC, Syncarb F474 from Omya). The amount of pigment suspension (corresponds to filler suspension) added was adjusted in multiple preliminary tests such that the pigment content of the laboratory sheets subsequently formed was about 20%. The fibrous suspension was processed on a Rapid-Köthen sheet-former into sheets having a grammage of 100 g/sqm to ISO 5269/2 two minutes after pigment addition. The wet sheets were subsequently removed from the wire frame and placed between two suction felts. The pack consisting of suction felts and the wet paper was subsequently pressed in a static press at a press pressure of 6 bar. In each case, pressing was done to a 50 wt % solids content of the wet sheets.

Examples 4, 5 and 7

Not According to the Invention

Three glass beakers were each filled with 50 g of the above-described pretreated fibrous suspension. Two of the glass beakers each had 2 g of a 1 wt % aqueous solution of the one of the above-described polymers IV and V added to it with slight gentle stirring of the fibrous suspension. The fibrous material in the third glass beaker served as reference and was left untreated (Example 7).

The fibrous suspensions were each subsequently reduced to a fibrous concentration of 0.35% by addition of water in all three glass beakers. This was followed by addition of a 20 wt % carbonate pigment slurry (PCC, Syncarb F474 from Omya). The amount of pigment suspension added was adjusted in multiple preliminary tests such that the pigment content of the laboratory sheets subsequently formed was about 20%. The fibrous suspension was processed on a Rapid-Köthen sheet-former into sheets having a grammage of 100 g/sqm to ISO 5269/2 two minutes after pigment addition.

The wet sheets were subsequently removed from the wire frame and placed between two suction felts. The pack consisting of suction felts and the wet paper was subsequently pressed in a static press at a press pressure of 6 bar. In each case, pressing was done to a 50 wt % solids content of the wet sheets by adapting the residence time of the papers within the press assembly.

Example 6

Not According to the Invention—Addition to Thin Stuff 50 g of the pretreated fibrous suspension (thick stuff) was diluted with 450 g of water to a fibrous concentration of 0.35% (corresponds to 3.5 g/l).

To 500 g of the diluted fibrous suspension (thin stuff) were added 2 g of a 1 wt % aqueous solution of polymer I (corresponds to 1 wt % of polymer (solids) based on fibrous material (solids)).

This was followed by addition of a 20 wt % carbonate pigment slurry (PCC, Syncarb F474 from Omya). The amount of pigment suspension added was adjusted in multiple preliminary tests such that the pigment content of the laboratory sheets subsequently formed was about 20%.

The fibrous suspension was processed on a Rapid-Köthen sheet-former into sheets having a grammage of 100 g/sqm to ISO 5269/2 two minutes after pigment addition. The wet sheets were subsequently removed from the wire frame and placed between two suction felts. The pack consisting of suction felts and the wet paper was subsequently pressed in a static press at a press pressure of 6 bar. By adapting the residence time of the papers within the press arrangement, pressing was in each case carried on to a 50 wt % solids content of the wet sheets.

Examples 8, 9 and 10

Not According to the Invention

Three glass beakers were each filled with 50 g of the above-described pretreated fibrous suspension. Each of the glass beakers had added to it 2 g in each case of a 1 wt % aqueous solution of one of the above-described polymers I-III under gentle stirring of the fibrous suspension (corresponds to 1% of polymer (solids) per fibrous material (solids)). The fibrous suspensions were each subsequently reduced to a fibrous concentration of 0.35% by addition of water. This was followed by addition of a 20 wt % carbonate pigment slurry (PCC, Syncarb F474 from Omya). The amount of pigment suspension added was adjusted in multiple preliminary tests such that the pigment content of the laboratory sheets subsequently formed was about 20%. The fibrous suspension was processed on a Rapid-Köthen sheet-former into sheets having a grammage of 100 g/sqm to ISO 5269/2 two minutes after pigment addition. The wet sheets were subsequently removed from the wire frame and placed between two suction felts. The pack consisting of suction felts and the wet paper was subsequently pressed in a static press at a press pressure of 6 bar. By adapting the residence time within the press arrangement, pressing was in each case carried on to a solids content of the wet sheets which is discernible from Table 1.

Example 11

Example 7 was repeated using untreated pigment (PCC, Syncarb F474 from Omya). The press time in the static press was adjusted such that the solids content of the wet sheets was below the limiting dry matter content having regard to the pigment content. In this case, i.e., below 50%, at 48.7%.

Performance Testing: Determination of Initial Wet Web Strength

Initial wet web strength must not be confused with a paper's wet strength and initial wet strength since both these properties are measured on papers which, after drying, are wetted back to a defined water content. Initial wet strength is an important parameter in the assessment of papers without permanent wet strength. A dried and subsequently remoistened paper has a completely different wet strength than a moist paper directly after it has passed through the wire and press sections of a papermachine.

Initial wet web strength is determined on wet paper using the Voith method (cf. M. Schwarz and K. Bechtel "Initiale Gefügefestigkeit bei der Blattbildung", in Wochenblatt für Papierfabrikation 131, pages 950-957 (2003) No. 16). The wet sheets after pressing in the static press were knocked off onto a plastics support and transferred to a cutting support. Test strips having a defined length and width were then cut out of the sheet. They were pressed under constant pressure until the desired dry matter content was reached. To investigate the sheets of paper obtained according to the examples reported above, four dry matter contents ranging between 42% and 58% were established in each case. These values were used to determine initial wet web strength at 50% dry matter using a fitting method described in the abovementioned literature reference. The actual measurement of initial wet web strength took place on a vertical tensile tester using a special clamping device. The force determined in the tension machine was converted into the grammage-independent INF index. For an exact description of the clamping device, the measuring procedure, the determination of the dry matter in the paper and the data processing, the abovementioned literature reference can be enlisted.

The results of the tests are reproduced in Table 1.

TABLE 1

Results of performance testing for production of paper having a filler content of 20 wt %.

| Example | Polymer | INF index [Nm/g] | Solids content pressed [%] |
|---|---|---|---|
| 1 | I | 3.3 | 50.3 |
| 2 | II | 3.1 | 50.5 |
| 3 | III | 2.9 | 50.2 |
| 4 not according to the invention | IV | 2.1 | 50.9 |
| 5 not according to the invention | V | 2.0 | 51.2 |
| 6 not according to the invention (polymer I in thin stuff) | I | 2.2 | 50.6 |
| 7 not according to the invention | — | 1.7 | 51.3 |
| 8 not according to the invention | I | 1.5 | 48.6 |
| 9 not according to the invention | II | 1.4 | 48.8 |
| 10 not according to the invention | III | 1.3 | 48.3 |
| 11 not according to the invention | — | 1.4 | 48.7 |

According to the computation of the limiting dry matter content G(x) = G(20), the invention requires pressing to a solids content of at least 50 wt %: G(20) = 48 + (20 − 15) · 0.4 = 50

This application claims priority from U.S. provisional application No. 61/499204, incorporated herein by reference.

We claim:

1. A process for producing paper, card and board, the process comprising draining a filler-containing paper stock comprising at least one water-soluble amphoteric copolymer with sheet formation in the wire section and then pressing the paper in the press section to form a product, wherein:

a paper stock having a fibrous concentration in the range from 20 to 40 g/l has the at least one water-soluble amphoteric copolymer added to it, then the paper stock is diluted to a fibrous concentration in the range from 5 to 15 g/l, the diluted paper stock is drained to form a sheet, and the sheet is pressed in the press section to a solids content G(x) wt % or greater and G(x) computes according to:

$$G(x)=48+(x-15)\cdot 0.4,$$

where x is a filler content of the product (in wt %) and G(x) is a minimal solids content (in wt %) to which the sheet is pressed;

the water-soluble amphoteric copolymer is obtained by polymerizing a mixture of a) 20 to 60 mol % of acrylamide, based on a total number of moles of monomers in the polymerizing, b) 20 to 60 mol %, based on the total number of moles of monomers in the polymerizing, of at least one cationic monomer, c) 20 to 60 mol %, based on the total number of moles of monomers in the polymerizing, of at least one anionic monomer selected from the group consisting of a monoethylenically unsaturated $C_3$ to $C_5$ carboxylic acid, a monoethylenically unsaturated $C_3$ to $C_5$ dicarboxylic acid, a sulfonic acid, a phosphonic acid, and salts thereof, d) 0 to 30 mol %, based on the total number of moles of monomers in the polymerizing, of one or more monoethylenically unsaturated monomers other than said monomers (a), (b) and (c), and e) 0 to 5 mol %, based on the total number of moles of monomers in the polymerizing, of one or more compounds comprising two or more ethylenically unsaturated double bonds;

a difference between the fractions of the cationic monomer and the anionic monomer in mol %, based on the total number of moles of monomers in the polymerizing, is not more than 10 mol %;

the at least one cationic monomer b) is selected from the group consisting of an ester of an α,β-ethylenically unsaturated monocarboxylic acid with an amino alcohol, an ester of an α,β-ethylenically unsaturated dicarboxylic acid with an amino alcohol, an amide of an α,β-ethylenically unsaturated monocarboxylic acid with a diamine, an amide of an α,β-ethylenically dicarboxylic acid with a diamine, an N—$C_1$-$C_8$-monoalkylated or N—$C_1$-$C_8$-dialkylated derivative thereof, and quaternary compounds thereof; and the product has an initial wet web strength index of ≥2.9 Nm/g.

2. A process for producing paper, card and board, the process comprising draining a filler-containing paper stock comprising at least one water-soluble amphoteric copolymer with sheet formation in the wire section and then pressing the paper in the press section to form a product, wherein:

a paper stock having a fibrous concentration in the range from 20 to 40 g/l has the at least one water-soluble amphoteric copolymer added to it, then the paper stock is diluted to a fibrous concentration in the range from 5 to 15 g/l, the diluted paper stock is drained to form a sheet, and the sheet is pressed in the press section to a solids content ≥48 wt %;

the water-soluble amphoteric copolymer is obtainable by polymerizing a mixture of a) 20 to 60 mol % of acrylamide, based on the total number of moles of monomers in the polymerizing, b) 20 to 60 mol %, based on the total number of moles of monomers in the polymerizing, of at least one cationic monomer, c) 20 to 60 mol %, based on the total number of moles of monomers in the polymerizing, of at least one anionic monomer selected from the group consisting of a monoethylenically unsaturated $C_3$ to $C_5$ monocarboxylic acid, a monoethylenically unsaturated $C_3$ to $C_5$ dicarboxylic acid, a sulfonic acid, a phosphonic acid, and salts thereof, d) 0 to 30 mol %, based on the total number of moles of monomers in the polymerizing, of one or more monoethylenically unsaturated monomers other than said monomers (a), (b) and (c), and e) 0 to 5 mol %, based on the total number of moles of monomers in the polymerizing, of one or more compounds comprising two or more ethylenically unsaturated double bonds;

a difference between the fractions of the cationic monomer and the anionic monomer in mol %, based on a total number of moles of monomers in the polymerizing, is not more than 10 mol %;

the at least one cationic monomer b) is selected from the group consisting of an ester of an α,β-ethylenically unsaturated monocarboxylic acid with an amino alcohol, an ester of an α,β-ethylenically unsaturated dicarboxylic acid with an amino alcohol, an amide of an α,β-ethylenically unsaturated monocarboxylic acid with a diamine, an amide of an α,β-ethylenically dicarboxylic acid with a diamine, an N—$C_1$-$C_8$-monoalkylated or N—$C_1$-$C_8$-dialkylated derivative thereof, and quaternary compounds thereof; and the product has an initial wet web strength index of ≥2.9 Nm/g.

3. The process according to claim 1 or 2 wherein the paper stock comprises a fibrous material having a freeness of ≤30° SR.

4. The process according to claim 1 or claim 2, wherein the water-soluble amphoteric copolymer is added to the paper stock having a fibrous concentration in the range from 20 to 40 g/l and before adding a filler.

5. The process according to claim 1 or claim 2, wherein the water-soluble amphoteric copolymer is added in an amount of 0.05 to 5.00 wt %, based on fibrous material.

6. The process according to claim 1 or claim 2, wherein the water-soluble amphoteric copolymer is obtainable by polymerizing a mixture comprising at least one cationic monomer selected from the group consisting of an ester of an α,β-ethylenically unsaturated monocarboxylic acid with an amino alcohol, an ester of an α,β-ethylenically unsaturated dicarboxylic acid with an amino alcohol, an amide of an α,β-ethylenically unsaturated monocarboxylic acid with a diamine, an amide of an α,β-ethylenically unsaturated dicarboxylic acid with a diamine, and an N—$C_1$-$C_8$-monoalkylated or N—$C_1$-$C_8$-dialkylated derivative thereof.

7. The process according to claim 1 or claim 2, wherein the water-soluble amphoteric copolymer is obtainable by polymerizing a mixture comprising at least one anionic monomer selected from the group consisting of acrylic acid, methacrylic acid, maleic acid, itaconic acid, acrylamido-2-methylpropanesulfonic acid, and salts thereof.

8. The process according to claim 1 or claim 2, wherein the water-soluble amphoteric copolymer is obtainable by polymerizing a mixture of a) 20 to 50 mol % of the acrylamide, based on the total number of moles of monomers in the polymerizing, b) 25 to 40 mol %, based on the total number of moles of monomers in the polymerizing, of the at least one cationic monomer, c) 25 to 40 mol %, based on the total number of moles of monomers in the polymerizing, of the at least one anionic monomer selected from the group consisting of a monoethylenically unsaturated $C_3$ to $C_5$ monocarboxylic acid, a monoethylenically unsaturated $C_3$ to $C_5$ dicarboxylic acid, a sulfonic acid, a phosphonic acid, and salts thereof, d) 0 to 30 mol %, based on the total number of moles of monomers in the polymerizing, of the one or more monoethylenically unsaturated monomers other than said monomers (a), (b) and (c), and e) 0 to 5 mol %, based on the total number of moles of monomers in the polymerizing, of the one or more compounds comprising two or more ethylenically unsaturated double bonds, wherein the difference between the fractions of the cationic monomer and the anionic monomer in mol %, based on the total number of moles of monomers in the polymerizing, is not more than 10 mol %.

9. The process according to claim 2, wherein:

the product is a paper, a card, or a board, having a filler content of 17 to 32 wt %; and the process comprises pressing in the press section to at least a solids content in the range from 49 to 55 wt %.

10. The process according to claim 2, wherein:

the product is a paper, a card, or a board, having a filler content of 5 to 15 wt %; and the process comprises pressing in the press section to a solids content of at least 48 wt %.

11. The process of claim 1, wherein the at least one cationic monomer b) is selected from the group consisting of N-methylaminomethyl(meth)acrylate, N-methylaminoethyl (meth)acrylate, N,N-dimethylaminomethyl (meth)acrylate, N,N-dimethylaminoethyl(meth)acrylate, N,N-diethylaminoethyl(meth)acrylate, N,N-dimethylaminopropyl(meth)acrylate, N,N-diethylaminopropyl(meth)acrylate, N,N-dimethylaminocyclohexyl(meth)acrylate, N[2-(dimethylamino) ethyl]acrylamide, N-[2-(dimethylamino)ethyl] methacrylamide, N-[3-(dimethylamino)propyl]acrylamide, N-[3-(dimethylamino)propyl]methacrylamide, N[4-(dimethylamino)butyl]acrylamide, N-[4-(dimethylamino)butyl] methacrylamide, N-[2-(diethylamino)ethyl]acrylamide, N-[2-(diethylamino)ethyl]methacrylamide, and the quaternary compounds thereof.

12. The process of claim 2, wherein the at least one cationic monomer b) is selected from the group consisting of N-methylaminomethyl(meth)acrylate, N-methylaminoethyl (meth)acrylate, N,N-dimethylaminomethyl(meth)acrylate, N,N-dimethylaminoethyl(meth)acrylate, N,N-diethylaminoethyl(meth)acrylate, N,N-dimethylaminopropyl(meth)acrylate, N,N-diethylaminopropyl(meth)acrylate, N,N-dimethylaminocyclohexyl(meth)acrylate, N[2-(dimethylamino) ethyl]acrylamide, N-[2-(dimethylamino)ethyl] methacrylamide, N-[3-(dimethylamino)propyl]acrylamide, N-[3-(dimethylamino)propyl]methacrylamide, N-[4-(dimethylamino)butyl]acrylamide, N-[4-(dimethylamino)butyl] methacrylamide, N-[2-(diethylamino)ethyl]acrylamide, N-[2-(diethylamino)ethyl]methacrylamide, and the quaternary compounds thereof.

13. The process of claim 1, wherein the water-soluble amphoteric copolymer is obtainable by polymerizing a mixture comprising:

a) 30 to 50 mol % of acrylamide, based on the total number of moles of monomers in the polymerizing;

b) 25 to 32 mol %, based on the total number of moles of monomer in the polymerizing, of the at least one cationic monomer; and c) 20-40 mol %, based on the total number of moles of monomers in the polymerizing, of sodium acrylate.

14. The process of claim 2, wherein the water-soluble amphoteric copolymer is obtainable by polymerizing a mixture comprising:

a) 30 to 50 mol % of acrylamide, based on the total number of moles of monomers in the polymerizing;

b) 25 to 32 mol %, based on the total number of moles of monomer in the polymerizing, of the at least one cationic monomer; and c) 20-40 mol %, based on the total number of moles of monomers in the polymerizing, of sodium acrylate.

15. The process of claim 1, wherein the water-soluble amphoteric copolymer is obtainable by polymerizing a mixture comprising:

a) 30 to 50 mol % of acrylamide, based on the total number of moles of monomers in the polymerizing;

b) 25 to 32 mol %, based on the total number of moles of monomer in the polymerizing, of acryloyloxyethyltrimethylammonium chloride; and c) 20-40 mol %, based on the total number of moles of monomers in the polymerizing, of sodium acrylate.

16. The process of claim 2, wherein the water-soluble amphoteric copolymer is obtainable by polymerizing a mixture comprising:

a) 30 to 50 mol % of acrylamide, based on the total number of moles of monomers in the polymerizing;

b) 25 to 32 mol %, based on the total number of moles of monomer in the polymerizing, of acryloyloxyethyltrimethylammonium chloride; and c) 20-40 mol %, based on the total number of moles of monomers in the polymerizing, of sodium acrylate.

* * * * *